US006218921B1

(12) United States Patent
Eberts et al.

(10) Patent No.: US 6,218,921 B1
(45) Date of Patent: Apr. 17, 2001

(54) ADJUSTABLE FLUX TRANSFER SHUNT TRIP ACTUATOR AND ELECTRIC POWER SWITCH INCORPORATING SAME

(75) Inventors: William George Eberts, Moon Township; Robert Michael Slepian, Murrysville; James Russell Everett, Ohioville, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/512,534

(22) Filed: Feb. 24, 2000

(51) Int. Cl.[7] ..... H01H 9/00

(52) U.S. Cl. ..... 335/176; 335/42; 335/172; 335/174; 335/179; 335/229

(58) Field of Search ..... 335/167, 171, 335/172, 176, 177, 179, 229–234, 274, 21, 38, 42

(56) References Cited

U.S. PATENT DOCUMENTS 4,489,295 12/1984 Altenhof, Jr. et al. .
4,639,701 1/1987 Shimp .
5,453,724 9/1995 Seymour et al. .
5,886,605 3/1999 Ulerich et al. .
5,912,604 * 6/1999 Harvey et al. ..... 335/9

* cited by examiner

*Primary Examiner*—Ray Barrera
(74) *Attorney, Agent, or Firm*—Martin J. Moran

(57) ABSTRACT

A flux transfer shunt trip actuator has an elongated seat member extending between the legs of a U-shaped magnetically permeable frame member. A plunger is magnetically latched against the seat formed by the seat member in a retracted position by permanent magnets positioned adjacent the seat. The field generated by permanent magnets produces a latching force which exceeds a bias force generated by a helical compression spring extending along the elongated seat member and biasing the plunger toward an actuated position spaced from the seat. A coil surrounding the elongated seat member and the spring, generates an electromagnetic field when energized which bucks the permanent magnet field so that the plunger is driven to the actuated position by the spring. Preload on the spring is adjusted by an adjusting member positioned along a threaded shaft coaxial with the spring and extending from the bight of the U-shaped frame in the opposite direction from the pair of legs of the frame. A pair of opposed cylindrical sections project from the adjusting member through the bight and bear against the spring.

17 Claims, 2 Drawing Sheets

ADJUSTABLE FLUX TRANSFER SHUNT TRIP ACTUATOR AND ELECTRIC POWER SWITCH INCORPORATING SAME

BACKGROUND OF THE INVENTION

Field of the Invention

This invention relates to actuators for electrically operating switches in electric power circuits, and to electric power switches incorporating such actuators. The actuator is a flux transfer shunt trip actuator in which a coil is pulsed to generate a field which bucks the holding force generated by permanent magnets so that the spring drives the actuator to an actuated position to trip the operating mechanism of the electric power switch. More particularly, it relates to an arrangement for adjusting the response of the flux transfer shunt trip actuator.

Background Information

Electric power switches, such as for example, circuit breakers, transfers switches, network protectors, disconnects, and the like, typically have a stored energy powered operating mechanism that is tripped to rapidly open the power contacts of the switch. It is common to have electrically actuated devices actuating or tripping the operating mechanism. Even in the case of a circuit breaker with a thermal-magnetic trip unit, an electrically actuated device is often also provided to alternatively actuate the operating mechanism from a remote location or for other conditions, such as under voltage, loss of phase, or off frequency. In many cases, an electronic trip circuit is used instead of a thermal-magnetic mechanism for overcurrent protection.

It is becoming wide spread for the electronic circuits now used to actuate these trip devices to generate logic levels signals which have insufficient energy to actuate solenoids previously used for these purposes. A low energy device which has been developed to trip the operating mechanism of an electric power switch in response to logic level signals, is the flux transfer shunt trip actuator. These devices utilize a spring to bias a plunger to an actuated position. Permanent magnets generate sufficient magnetic force to override the actuating force generated by this spring and hold the plunger in an unactuated, typically a retracted, position. The actuating signal is applied to a coil to generate an electromagnetic force which bucks the force generated by the permanent magnets. With the permanent magnet field at least partially cancelled, the spring actuates the plunger. A short duration pulse applied to the coil is sufficient to actuate the plunger and trip the operating mechanism of the switch.

While these flux transfer shunt trip devices are very effective, slight variations in the strength of the magnets, springs, or even plating thicknesses can affect the current required to release the plunger. U.S. Pat. No. 5,886,605 discloses a flux transfer shunt trip actuator which incorporates an arrangement for calibrating the device. In this patented actuator, the spring biasing the plunger to the tripped position is mounted inside the cylindrical plunger. A screw threaded into the free end of the plunger bears against the spring to adjust the spring preload. While this is effective for calibrating the device, it results in changing the effective length of the plunger, and therefore, varies the spacing between the plunger and a trip button on the operating mechanism of the electric power switch.

Accordingly, there is room for improvement in flux transfer shunt trip actuators and electric power switch incorporating them.

In fact, there is a need for a flux transfer shunt trip actuator and an electric power switch incorporating such an actuator, which provides an improved arrangement for calibrating the actuator.

More particularly, there is a need for such an actuator and electric power switch incorporating the actuator, in which the actuator can be calibrated without affecting the spacing between the actuator plunger and the operating mechanism of the electric power switch.

There is a more specific need, for an improved flux transfer shunt trip device and an electric power switch incorporating the actuator, in which the preload on a spring biasing the actuator plunger can be adjusted without affecting the positioning or length of the plunger.

SUMMARY OF THE INVENTION

These needs and others are satisfied by the invention which is directed to a flux transfer shunt trip actuator in which the actuator can be calibrated by adjustment of the preload biasing spring without changing the position or length of the actuator plunger biased by this spring. More particularly, the invention relates to a flux transfer shunt trip actuator which includes a housing having a magnetically permeable seat, a magnetically permeable plunger mounted by the housing for movement between a retracted position with a first end seated against the seat and an actuated position with the magnetically permeable plunger spaced from the seat. A biasing spring biases the plunger toward the actuated position. One or more permanent magnets generate a permanent magnet force sufficient to overcome the biasing spring to hold the magnetically permeable plunger in a retracted position seated against the magnetically permeable seat. A coil generates an electromagnetic field when energized which bucks the permanent magnet field so that the biasing spring moves the plunger to the actuated position. An adjustment device adjusts the preloading on the biasing spring without adjusting the position or length of the plunger.

More specifically, the housing comprises a magnetically permeable U-shaped frame having a bight and a pair of legs spaced apart and extending from the bight. The permanent magnet or magnets are mounted between the legs and define a gap. A magnetically permeable seat member projecting from the bight toward the gap terminates in a free end which forms the seat. The first end of the magnetically permeable plunger extends into the gap when seated in the retracted position against the seat. The biasing spring has a first end bearing against the magnetically permeable plunger and the adjusting device comprises an adjusting member and a mount mounting the adjusting member for movement relative to the bight toward and away from the magnetically permeable plunger. The adjusting member bears against the second end of the biasing spring to adjust the preload. Thus, the actuator is calibrated through adjustment of the preload on the biasing spring, yet the plunger length and position do not change.

Even more specifically, the mount for the adjusting member is a threaded shaft which is coaxial with the seat member. The adjusting member is moved along the threaded shaft by a threaded member which engages the threaded shaft and bears against the adjustment member to set the position of the adjusting member on the threaded shaft and, therefore, the preload on the spring. In a preferred embodiment of the invention, the threaded shaft projects from the bight of the frame in a direction opposite the orientation of the legs of the frame. The adjusting member has at least one projection extending toward and engaging the first end of the biasing spring. In a particularly preferred embodiment, these projections extend through apertures in the bight of the frame and are a pair of opposed cylindrical sections each bearing against the biasing spring which is a helical compression spring coaxially mounted on the seat member together with the coil.

The invention also embraces the electric power switch incorporating such an adjustable flux transfer shunt trip actuator.

It is therefore, an object of the invention to provide an improved flux transfer shunt trip actuator and an electric power switch incorporating such an actuator.

It is a further object of the invention to provide such an improved actuator and electric power switch incorporating the actuator in which the actuator can be calibrated without affecting the length of the actuator plunger.

It is a more specific object of the invention to provide such actuator and electric power switch which can be calibrated by adjusting the preload on the biasing spring without changing the position or length of the plunger.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The invention is directed toward an adjustable flux transfer shunt trip actuator for an electric power switch, such as, for example, a circuit breaker, a transfer switch, a disconnect switch, and the like. For purposes of illustration, the invention will be described in relation to a circuit breaker.

Figure 1:
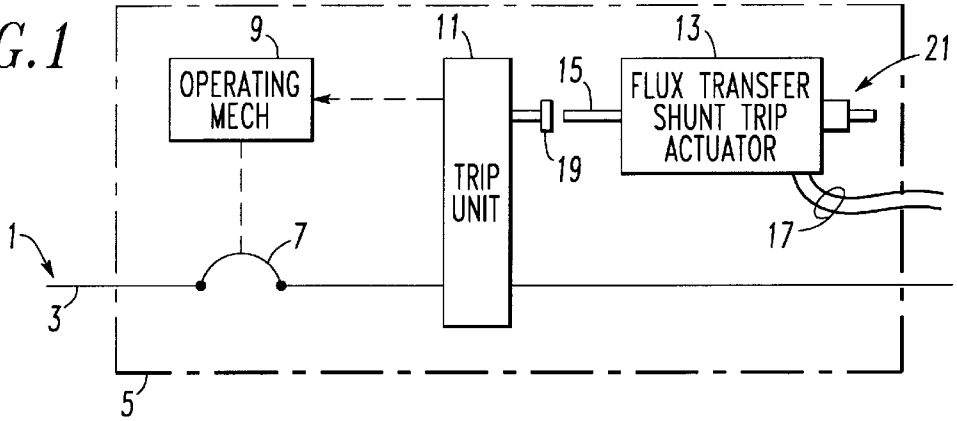
FIG. 1 is a schematic illustration of an electric power switch in the form of a circuit breaker employing an adjustable flux transfer shunt trip actuator in accordance with the invention.

Referring to FIG. 1, an electric power circuit 1 having conductors 3 is protected by a circuit breaker 5. The circuit breaker includes a pair of separable power contacts 7 connected in the conductors 3. While a single line representation of the conductors 3 is used for clarity, the electrical power system can be multiphase, typically 3 phase, in which case, separable contacts 7 would be connected in series with each phase conductor.

The circuit breaker 5 includes an operating mechanism 9 which is typically a spring powered mechanism which opens and closes the separable contacts 7. As is conventional, the operating mechanism can be manually operated to open and close the separable contacts 7.

The operating mechanism can also be automatically operated to open the separable contact 7 in response to overcurrent conditions in the conductors 3 by a trip unit 11. The trip unit can be either of the well-known thermal-magnetic type or electronic type. In either case, the trip unit 11 monitors the current in the conductors 3 and trips the operating mechanism 9 under certain overcurrent conditions.

The circuit breaker 5 also includes a flux transfer shunt trip actuator 13 having a plunger 15 which is normally held in a retracted position shown in FIG. 1. In the circuit breaker shown, the flux transfer shunt trip actuator 13 provides an auxiliary means for opening the separable contacts 7. The actuator 13 is actuated by an electrical signal provided on the leads 17. This signal can be generated in several ways. For instance, the signal can be generated at a remote location as by an operator in a control room or at a panel board. Also, the signal on the lead 17 can be generated by an under voltage relay (not shown), a loss of phase relay (not shown) or an off-frequency relay (also not shown). When the flux transfer shunt trip actuator 13 is actuated, the plunger is extended to an actuated position in which it engages the trip unit, such as through a trip button 19. In accordance with the invention, the flux transfer shunt trip actuator 13 has an adjustment device 21 which allows the actuator to be calibrated for response to the actuating signal delivered on the leads 17.

Figure 2:
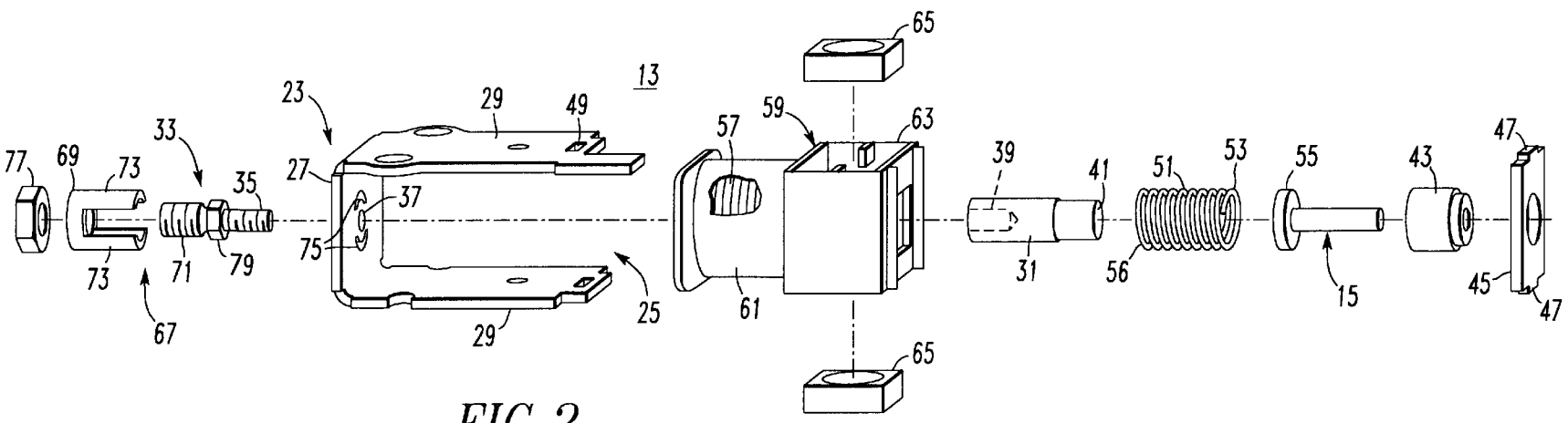
FIG. 2 is an exploded isometric view of the adjustable flux transfer shunt trip actuator.
Figure 3:
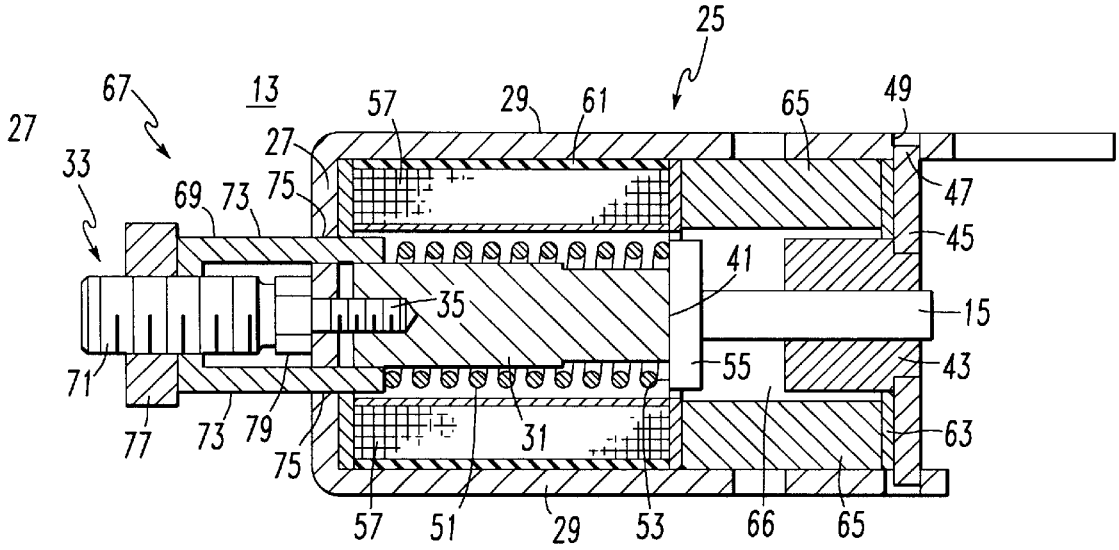
FIG. 3 is a longitudinal sectional view of the actuator assembled and in the retracted position.
Figure 4:
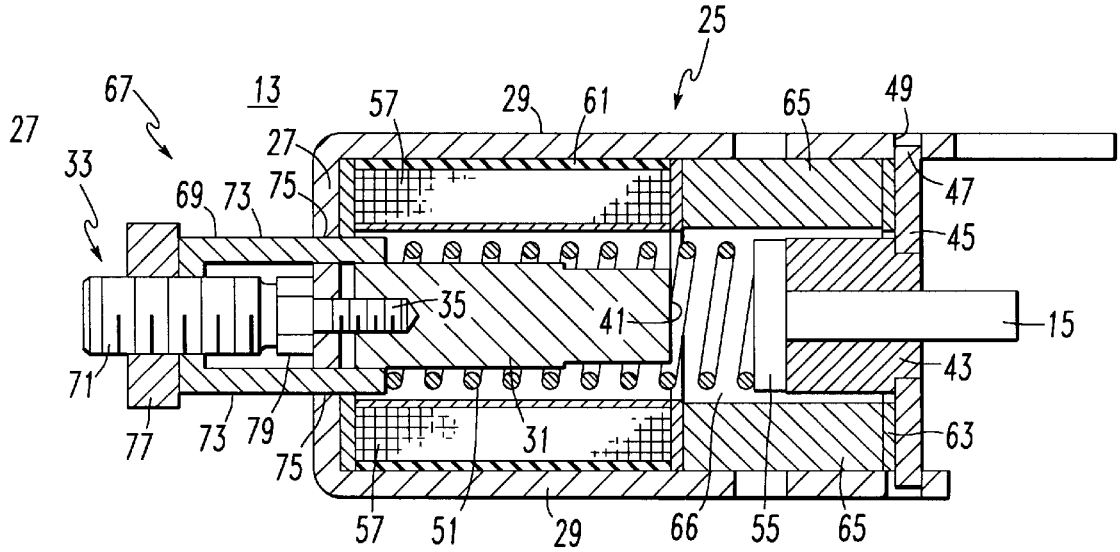
FIG. 4 is a longitudinal sectional view similar to that of FIG. 3 showing the actuator in the actuated position.

Turning to FIGS. 2–4, the flux transfer shunt trip actuator 13 includes a magnetically permeable frame 23 in the form of a U-shaped member 25 having a bight 27 and a pair of spaced apart legs 29 extending from the bight. A seat member in the form of a stationary pin 31 is secured to the bight by threaded shaft 33 having a first threaded end 35 which extends through an aperture 37 and threads into a tapped bore 39 in the seat member 31. The seat member 31 extends between the pair of legs 29 and terminates in a seat 41.

The magnetically permeable plunger 15 is supported for axial movement toward and away from the seat 39 by a nonmagnetically permeable guide 43 mounted in an end plate 45. The end plate 45 has tabs 47 which snap into openings 49 in the free ends of the pair of legs 29. A helical compression spring 51 is concentrically mounted on the seat member 31 and has a first end 53 which bears against a circular flange 55 forming a first end of the magnetically permeable plunger 15. The other or second end 56 of the spring 51 bears against the bight 27 of the U-shaped member 25.

A coil 57 is wound on one end of a molded bobbin 59 and is encapsulated by an insulating cover 61. The bobbin is supported between the pair of legs 29 on the U-shaped member 25 with the coil coaxial with and extending over the seat member 31 and the helical compression spring 51. The forward end 63 of the bobbin 59 forms a support for a pair of permanent magnets 65 which are spaced apart to form gap 66. These permanent magnets 65 generate a permanent magnet field which circulates through the magnets 65, the gap 66, the seat member 31, the bight 27 and the pair of legs 29.

The helical compression spring 51 biases the plunger 15 away from the seat 41 toward an extended or actuated position shown in FIG. 4. However, when the plunger is pushed inward so that the flange forming a first end 55 seats against the seat 41, the permanent magnet field generated by the magnets 65 is sufficient to overcome the bias generated by the spring and thereby magnetically latch the plunger in the retracted position shown in FIG. 3.

The coil 57 is wound such that when energized it generates an electromagnetic field which bucks the permanent magnet field generated by the permanent magnets 65. The bias force generated by the spring then exceeds the magnetic latching force and the plunger is driven by the spring to the actuated position shown in FIG. 4. With the coil deenergized, the actuator can be reset by physically pushing the plunger back to the retracted position.

As previously mentioned, variations in the strength of the permanent magnets 65, the spring 51 and even plating thicknesses on the U-shaped member 25, the seat member 31, or the plunger 15 can affect the current that must be applied to the coil in order to release the plunger. In order to compensate for these variations and provide for calibration of the actuator, the flux transfer shunt trip actuator 13 is provided with an adjusting device 67 for adjusting the preload on the bias and spring 51. The adjusting device 67 includes an adjusting member 69 which is moveable along a second threaded end 71 of the threaded shaft 33 which projects from the bight 27 in a direction opposite the direction of the pair of legs 29 and forms a mount for the adjusting member. This adjusting member has at least one projection, preferably a pair of opposed cylindrical sections 73 which extend through complementary apertures 75 in the bight 27 and bear against the biasing spring 51. The position of the adjusting member 69 on the threaded shaft 33 is set by a threaded member in the form of nut 77. By turning the nut 77 to move the adjusting member 69 toward the bight 27, the preload on this biasing spring 51 is increased. The threaded shaft 33 has a hexagonal center section 79 by which it may be gripped for threading the first threaded end 35 into the seat member 31 during assembly.

Thus, it can be appreciated that movement of the adjusting member 69 toward and away from the bight 27 increases or decreases the preload on the spring 51, respectively, but does not affect the position, or the length of the plunger 15. Also, since the adjustment is made at the rear end of the actuator, the adjustments can easily be made with the actuator in place.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A flux transfer shunt trip actuator for an electric power switch comprising:

a magnetically permeable frame incorporating a seat;

a magnetically permeable plunger mounted within said magnetically permeable frame for movement between a retracted position with a first end seated against said seat and an actuated position with said magnetically permeable plunger spaced from said seat;

a biasing spring biasing said magnetically permeable plunger toward said actuated position;

at least one permanent magnet generating a permanent magnet force sufficient to overcome said biasing spring to hold said magnetically permeable plunger in said retracted position seated against said seat;

a coil generating an electromagnetic force when energized bucking said permanent magnet force so that said biasing spring moves said magnetically permeable plunger to said actuated position;

an adjustment device adjusting preloading on said biasing spring without adjusting position or length of said magnetically permeable plunger; and wherein said magnetically permeable frame comprises a magnetically permeable U-shaped member having a bight and a pair of legs spaced apart and extending from said bight, said at least one permanent magnet being mounted between said pair of legs and defining a gap, said magnetically permeable frame further including a magnetically permeable seat member projecting from said bight toward said gap and terminating in a free end forming said seat, said first end of said magnetically permeable plunger extending into said gap when seated against said seat in said retracted position, said biasing spring extending along said seat member and having a first end bearing against said first end of said magnetically permeable plunger, and said adjustment device including an adjustment member, and a mount mounting said adjustment member for movement relative to said bight toward and away from said magnetically permeable plunger, said adjusting member bearing against said biasing spring to adjust preload on said biasing spring.

2. The flux transfer shunt trip actuator of claim 1 wherein said coil is mounted between said pair of legs of said magnetically permeable U-shaped member and concentric with said magnetically permeable seat member.

3. The flux transfer shunt trip actuator of claim 2 wherein said magnetically permeable seat member comprises an elongated solid member, and said biasing spring comprises a helical compression spring concentrically mounted over said elongated solid member.

4. The flux transfer shunt trip actuator of claim 1 wherein said mount comprises a threaded shaft co-axial with said magnetically permeable seat member, said adjusting member being moveable along said threaded shaft, said mount further including a threaded member engaging said threaded shaft and bearing against said adjusting member to position said adjusting member on said threaded shaft.

5. The flux transfer shunt trip actuator of claim 4 wherein said threaded shaft projects from said bight in a direction opposite of said pair of legs, said adjusting member being moveable along said threaded shaft and having at least one projection engaging said biasing spring.

6. The flux transfer shunt trip actuator of claim 5 wherein said at least one projection extending from said adjusting member comprises two projections extending through apertures in said bight.

7. The flux transfer shunt trip actuator of claim 6 wherein said two projections comprise a pair of opposed cylindrical sections.

8. The flux transfer shunt trip actuator of claim 7 wherein said coil is mounted in said U-shaped member co-axially with said magnetically permeable seat member and said cylindrical sections.

9. The flux transfer shunt trip actuator of claim 8 wherein said magnetically permeable seat member comprises an elongated solid member and said biasing spring comprises a helical compression spring concentrically mounted over said elongated solid member.

10. An electric power switch comprising:

separable electrical contacts;

an operating mechanism for closing said separable electrical contacts and for opening said separable electrical contacts when tripped; and a flux transfer shunt trip actuator comprising:

a U-shaped magnetically permeable frame member mounted adjacent said operating mechanism and having a bight and a pair of legs spaced apart and extending from said bight;

a magnetically permeable elongated seat member extending from said bight between said pair of legs;

a magnetically permeable plunger mounted between said pair legs for axial movement between a retracted position in which said magnetically permeable plunger is seated against said magnetically permeable elongated seat member and an actuated position in which said magnetically permeable plunger is spaced from said magnetically permeable elongated seat member;

a biasing spring mounted between said bight and said magnetically permeable plunger and having a first end bearing against said magnetically permeable plunger to bias plunger toward said actuated position;

permanent magnet means mounted between said pair of legs and said plunger generating a permanent magnet field which circulates through said permanent magnet means, said magnetically permeable plunger, said magnetically permeable elongated seat member, said bight and said pair of legs, said permanent magnet force being sufficient to overcome said biasing spring to hold said magnetic permeable plunger in said retracted position;

a coil generating an electromagnetic force when energized bucking said permanent magnet force so that said biasing spring moves said magnetically permeable plunger to said actuated position; and an adjustment device bearing against a second end of said biasing spring to selectively position said second end of said biasing spring to adjust preload on said biasing spring.

11. The electric power switch of claim 10 wherein said permanent magnet means comprises at least two permanent magnets spaced apart between said pair of legs to form a gap into which said first end of said magnetically permeable plunger extends in said retracted position.

12. The electrical power switch of claim 11 wherein said biasing spring comprises a helical compression spring concentrically mounted with said magnetically permeable elongated seat member.

13. The electric power switch of claim 11 wherein said adjusting device comprises a mount in the form of a threaded shaft extending co-axially with said magnetically permeable elongated seat member, an adjusting member movable along said threaded shaft, and a threaded member threaded on said threaded shaft and bearing against said adjusting member to fix a position of said adjusting member along said threaded shaft.

14. The electric power switch of claim 13 wherein said threaded shaft projects axially from said bight in an opposite direction from said pair of legs, and wherein said adjusting member includes a pair of projections extending axially toward and bearing against said second end of said biasing spring.

15. The electric power switch of claim 14 wherein said pair of projections extend through openings in said bight.

16. The electric power switch of claim 15 wherein said pair of projections comprise opposed cylindrical sections.

17. The electric power switch of claim 16 wherein said coil is mounted between said pair of legs co-axially with said magnetically permeable elongated seat member, said helical compression spring, and said opposed cylindrical sections.

* * * * *